United States Patent [19]

Reinhall

[11] Patent Number: 4,606,789

[45] Date of Patent: Aug. 19, 1986

[54] METHOD FOR MANUFACTURING CELLULOSE PULP USING PLURAL REFINING AND FIBER SEPARATION STEPS WITH REJECT RECYCLING

[76] Inventor: Rolf Reinhall, 834, 171st Pl. NE., Bellevue, Wash. 98008

[21] Appl. No.: 574,153

[22] PCT Filed: May 3, 1983

[86] PCT No.: PCT/SE83/00177

§ 371 Date: Dec. 23, 1983

§ 102(e) Date: Dec. 23, 1983

[87] PCT Pub. No.: WO83/03856

PCT Pub. Date: Nov. 10, 1983

[30] Foreign Application Priority Data

May 4, 1982 [SE] Sweden ..... 8202790

[51] Int. Cl.[4] ..... D21B 1/12; D21B 1/14; D21D 1/30; D21D 5/24

[52] U.S. Cl. ..... 162/23; 162/26; 162/55; 209/11; 209/144

[58] Field of Search ..... 241/28, 79.1; 162/55, 162/23, 26; 209/11, 142, 144, 3

[56] References Cited

U.S. PATENT DOCUMENTS

| | | | |
|---|---|---|---|
| 4,034,862 | 7/1977 | Bahri et al. | 209/11 |
| 4,132,634 | 1/1979 | Rumpf | 209/144 |
| 4,156,485 | 5/1979 | Skardal | 209/144 |
| 4,235,665 | 11/1980 | Reinhall et al. | 162/23 |
| 4,292,122 | 9/1981 | Karnis et al. | 162/55 |
| 4,309,283 | 1/1982 | Vikio | 209/211 |
| 4,333,572 | 6/1982 | Fryhult | 209/211 |
| 4,418,871 | 12/1983 | Powell | 241/79.1 |

*Primary Examiner*—Steve Alvo

*Attorney, Agent, or Firm*—Eric Y. Munson

[57] ABSTRACT

A method and a means for manufacturing cellulose pulp from ligno-cellulose fiber material wherein the fiber material is treated under steam pressure. The treatment is carried out in a mill (18, 32) or similar means under such conditions that substantially all the liquid present in the material and/or added thereto during the treatment is converted into gaseous form or steam. The gas or steam thus generated, plus any added gas, is used to convey the cellulose material at high velocity to at least one subsequent separating vessel (22, 36, 38, 40) wherein the fibers entrained with the gas or steam are given a trajectory of motion in the course of which the fiber material is sorted with respect to weight, surface area, or other distinguishing features.

2 Claims, 4 Drawing Figures

METHOD FOR MANUFACTURING CELLULOSE PULP USING PLURAL REFINING AND FIBER SEPARATION STEPS WITH REJECT RECYCLING

BACKGROUND OF THE INVENTION

The present invention is concerned with a method of manufacturing cellulose pulp from ligno-cellulose material wherein the material is ground in a mill which is subjected to internal steam pressure. The invention is further concerned with means for the implementation of the method.

In such manufacture of cellulose pulp, especially for paper making, it is necessary in order for the pulp to be used efficiently that said pulp consist of a uniform fibre fraction without oversize non-comminuted (non-defibrated) knots or bundles of fibres. In conventional pulp manufacture this is achieved by slurrying the manufactured pulp with water, whereafter it is caused to pass in the form of a relatively thin suspension through a variety of fibre sorting means such as screens equipped with perforated or slotted plates for the removal of shives, or so-called hydrocyclones wherein the stock is cleaned of shives and insufficiently comminuted (defibrated) bundles of fibres by centrifugal action.

All these so-called water-dependent systems suffer from the drawback of requiring large quantities of water, in the order of 1:300 to 1:100, which water must be removed in subsequent treatment before the pulp is transported to the point of use, baled, etc. The suspension of the pulp in water and the transportation of the large volumes of liquid to screens and, hydrocyclones takes a great deal of energy, and moreover, the oversize bundles of fibres or shives removed in the screens and hydrocyclones must be dewatered again to a concentration of approximately 1:2 to 1:4 for efficient further treatment thereof.

SUMMARY OF THE INVENTION

The main object of the invention is to provide a method of the above-mentioned type whereby the pulp as manufactured can be cleaned and the shives or bundles of fibres removed in the cleaning process can be subjected to further treatment, without the addition of substantial quantities of water which must subsequently be removed by various dewatering methods. A further object of the invention is to provide such a method, economical of energy and water, which can be implemented in combination with the mechanical separation of lignocellulose material at temperatures in excess of 100° C. and/or at pressures exceeding normal atmospheric pressure.

BRIEF DESCRIPTION OF THE DRAWINGS

The invention will be more particularly described hereafter with reference to an embodiment, illustrated in the accompanying drawings, of a plant for the implementation of the method.

DETAILED DESCRIPTION OF THE INVENTION

Figure 1:
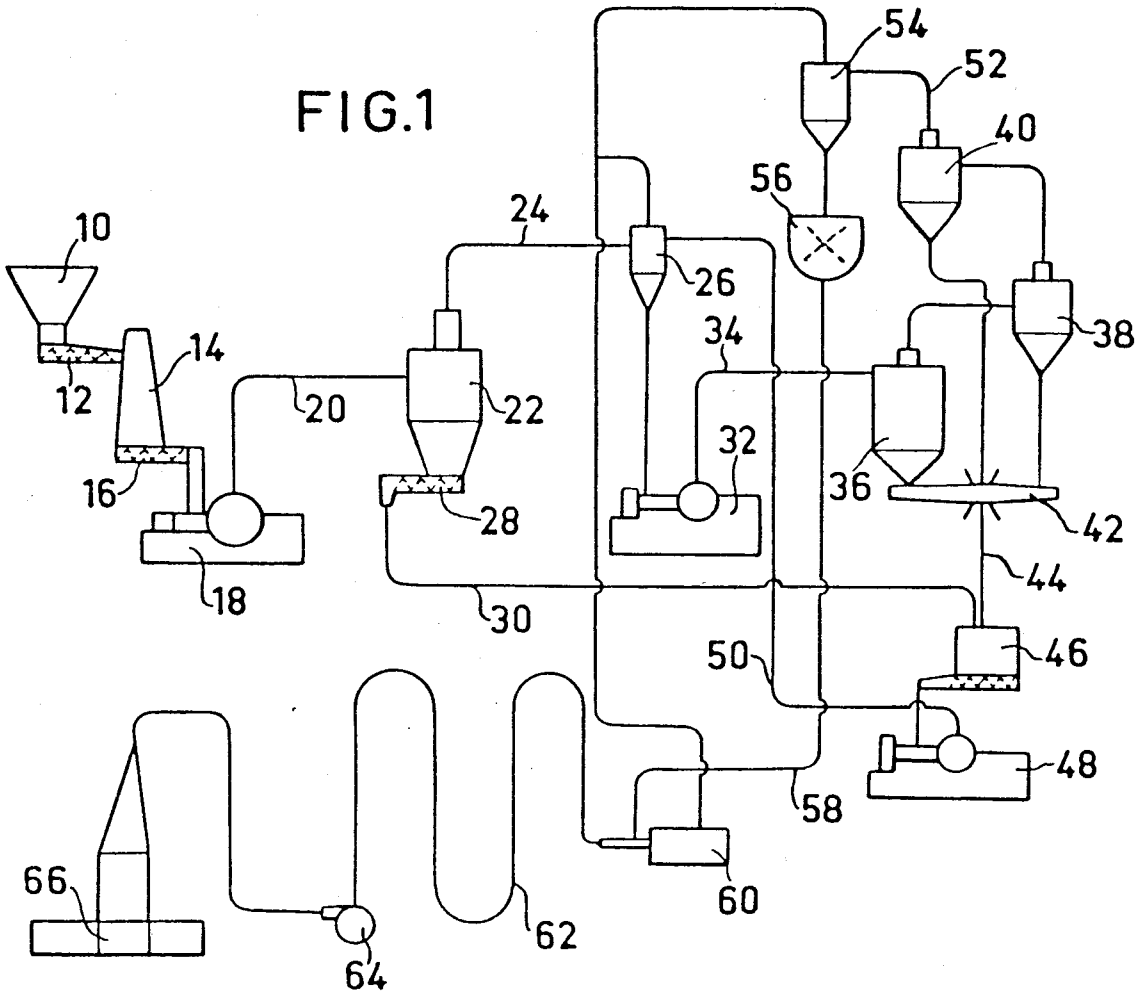
FIG. 1 is a schematic diagram of a plant implementing the method.

In the plant illustrated in FIG. 1, the number 10 indicates a feed hopper for a lignocellulose fibre material, such as wood chips. From the hopper 10 the material is fed by a screw 12 to a pre-heater 14 and from there by a screw 16 to a first defibrator 18, such as a disc defibrator, wherein the lignocellulose material, such as wood chips, is comminuted to single fibres or bundles of fibres. In this treatment, which may or may not be preceded by chemical treatment and/or heating in the pre-heater 14, most of the energy supplied to the material in the defibrator 18 is converted into heat. The natural moisture present in the material and/or water added to prevent overheating of the fibre material during defibration in the defibrator 18 is thereby converted into steam.

The steam thus generated, together with steam, compressed air, or other gases added during or after the defibration process in the defibrator 18, is now used according to the invention for the very effective removal of large, unwanted bundles of fibres or shives without the addition of water. This separation is effected by using the gas or steam so generated to carry the fibre material at high velocity via a pipeline 20 from the defibrator 18 to at least one separating vessel 22. In this vessel 22 fibres and/or fibre bundles of various sizes are separated by imparting to the cellulose suspension a motion such that a sorting of the fibres takes place according to certain distinguishing properties such as weight, size, or other similar feature. Separation may be assisted by changes in the velocity or motion of the cellulose suspension or by gravity, as is described more particularly below with reference to FIGS. 2 to 4.

The accepted fibres pass on via pipeline 24 to a cyclone steam separator 26, while the reject fibres or bundles are fed by a screw 28 to an outlet pipe 30. The accepted fibres are fed from the cyclone steam separator 26 to a refiner 32 for a second refining step. From the refiner 32 the cellulose suspension is carried via a pipeline 34 to a further separating step, which in the embodiment illustrated consists of three units 36, 38, and 40. These units are in the form of cleaning cyclones whose reject outlets are connected to a discharge means 42 whose outlet is connected to a pipeline 44 leading to a collector 46. The reject line 30 from the first cyclone separator 22 is also connected to the collector 46, so that all reject fibres and fibre bundles are collected therein. The contents of the collector 46 are fed to a defibrator 48 where the reject fibres or fibre bundles are re-treated and comminuted and the outlet of the defibrator 48 is connected via a pipeline 50 to the cyclone steam separator 26, i.e. the cellulose suspension discharged from the defibrator 48 is fed to the second refining step 32.

The outlet from the cyclone 36 in the second cleaning step is connected to the cyclone 38, whose outlet is in turn connected to cyclone 40. The accepted flow from cyclone 40 is fed via a pipeline 52 to a cyclone steam separator 54 from which the stock is fed to a stock chest 56. From the stock chest 56 the stock is drawn off via a pipeline 58 for further treatment or use. In the embodiment illustrated the pulp, after being dried in a drying plant 60 which may be served by steam from the cyclone steam separators 26, 54, is conveyed via a pipeline loop 62 and pump 64 to a baling station 66.

Figure 2:
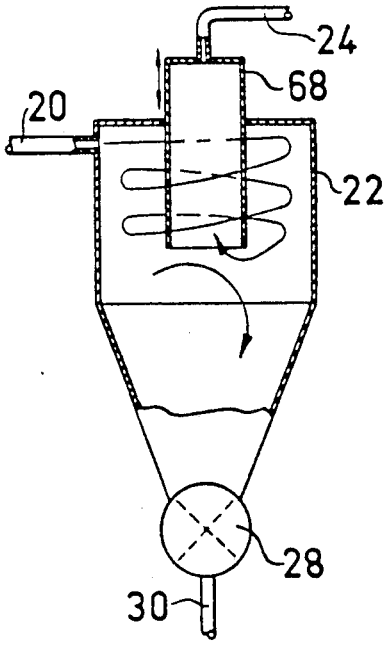
FIG. 2 is a section through a type of mechanical separator that can be used in the plant of FIG. 1.

The separator 22 used in the first separation step may, as shown in more detail in FIG. 2, include a steam-collecting and/or gas-collecting shell into which the pipeline 20 from the first defibration step discharges and into which the cellulose suspension is blown at high velocity by the energy supplied in the fibre separation step in the form of electricity and/or steam or compressed gas. On entering the cyclone 22 the pulp is thus given a rapid spiralling motion while at the same time the gas or steam fed to the cyclone causes the cellulose suspension to pass, against the action of centrifugal force, to an outlet pipe 68 located at the centre of the cyclone 22, to which pipe the pipeline 24 is connected. The sorting of the fibres or fibre bundles present in the gas or steam suspension is easily controlled by varying the quantity of steam or gas passed through the cyclone. For this purpose the pipe 68 may be arranged to be raised and lowered in the cyclone 22 so that by varying the vertical position of the outlet pipe 68 in relation to the conical lower part of the cyclone one can likewise control the separation of the fibres or fibre bundles. Through the action of centrifugal force the larger, heavier fibres and fibre bundles will offer greater resistance to the change of direction inwards towards the centre pipe 68 of the cyclone 22, with the result that the heavier particles will be entrained towards the bottom of the cyclone, where they are discharged by means of e.g. the discharge screw 28 shown in FIG. 1 to the discharge line 30.

Figure 3:
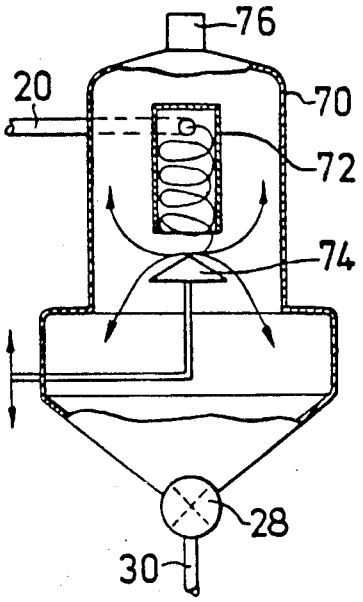
FIG. 3 is a section through another embodiment of mechanical separator.

In the embodiment illustrated in FIG. 3 the separator consists of a shell 70 having a centre pipe 72 to which is connected a feed line for the cellulose suspension such as the feed line 20 in FIG. 1. Thus, in this embodiment the cellulose suspension enters the centre pipe and is set in rapid spiralling motion therein while simultaneously flowing downwards in the pipe 72. Below the pipe 72 there is provided a conical dish 74 on which the cellulose suspension impinges. The lighter, acceptable fibres will then be entrained with the gas or steam upwards inside the shell 70 to the outlet 76 which is connected to the pipeline 24 in FIG. 1, while heavier fibres and fibre bundles drop down inside the shell 72 to the conical bottom thereof, where they are discharged by the screw 28 to the reject line 30.

Figure 4:
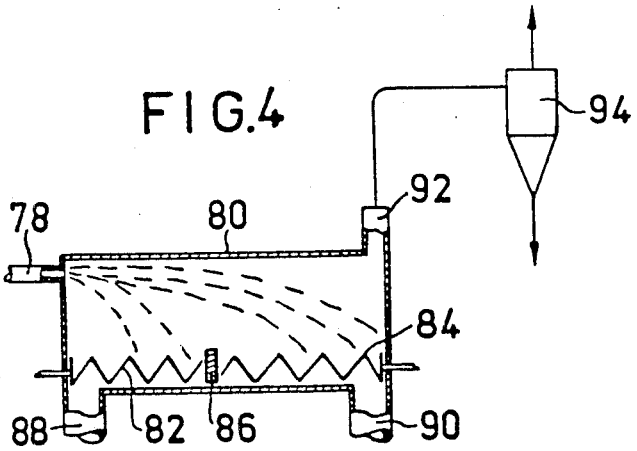
FIG. 4 is a longitudinal section through yet another type of separator.

The sorting of fibres and fibre bundles can also be effected by gravity, as illustrated in FIG. 4. In this case the cellulose suspension is introduced via a pipeline 78 at one end of an elongated shell 80 and blown at high velocity into the interior thereof. The heavier fibres and fibre bundles fall more rapidly to the bottom of the shell 80, while lighter, acceptable fibres follow a flatter trajectory inside the shell. In the bottom of the shell there are provided feed screws 82 and 84 for the respective stock fractions, which screws are separated by a partition 86. The screw 82 carries the rejected fibre bundles and shives to an outlet 88 which discharges to vessel 46 in FIG. 1. The screw 84 carries the acceptable fibres to an outlet 90 which is connected to the second refining stage 32 in FIG. 1. The steam is discharged via an outlet 92 from the shell 80 to a steam cyclone 94. By making the partition 86 moveable in the lengthwise direction of the casing 80 it is possible to control easily the sorting of the fibres or fibre bundles of various sizes present in the gas or steam suspension.

I claim:

1. The method of producing pulp from moisture-containing cellulosic fiber material comprising:

(a) treating the material in a pressurized refining zone (18) in a liquid-gas phase at super atmospheric pressure and correspondingly elevated temperature until substantially all of said liquid-gas phase is converted into a pressurized gaseous phase;

(b) passing a suspension of refined material and gaseous phase under high velocity into an initial fiber-separating zone (22) by using the energy of said pressurized gaseous phase as the propellant high-velocity force;

(c) separating fiber material from said initial fiber-separating zone (22) by imparting to the suspension by cyclonic means a trajectory of motion calculated to fractionate said suspension into an accepted fraction and a reject fraction according to weight, size or surface area of the fibers;

(d) discharging the reject fraction from said initial fiber-separating zone (22) and successively passing the accepted fraction to a steam separator (26) at least one further refining zone (32) and to at least one further fiber-separating zone (36) for further fractionation;

(e) passing the accepted fraction from said further fiber-separating zone (36) to a collection station (56) and recycling the reject fraction from said further fiber-separation zone (36) is passed to a reject refining zone (48) and said steam separator (26) before being recycled to said further refining zone (32).

2. The method according to claim 1, in which the reject fraction from said initial fiber-separating zone is passed to said reject refining zone (48) and recycled to said further refining zone (32) along with the reject fraction from said at least one further fiber-separating zone (36).

* * * * *